US007336255B2

(12) United States Patent
Nguyen et al.

(10) Patent No.: US 7,336,255 B2
(45) Date of Patent: Feb. 26, 2008

(54) SELECTABLE CONTINUOUS AND BURST MODE BACKLIGHT VOLTAGE INVERTER

(75) Inventors: Don J. Nguyen, Portland, OR (US); Alan L. Marquardt, Forest Grove, OR (US)

(73) Assignee: Intel Corporation, Santa Clara, CA (US)

( * ) Notice: Subject to any disclaimer, the term of this patent is extended or adjusted under 35 U.S.C. 154(b) by 516 days.

(21) Appl. No.: 10/750,140

(22) Filed: Dec. 31, 2003

(65) Prior Publication Data

US 2005/0146496 A1 Jul. 7, 2005

(51) Int. Cl.
*G09G 3/36* (2006.01)
*G09G 5/00* (2006.01)

(52) U.S. Cl. ..... 345/102; 345/211

(58) Field of Classification Search ..... 345/102, 345/211–213, 87, 204
See application file for complete search history.

(56) References Cited

U.S. PATENT DOCUMENTS

| | | | | |
|---|---|---|---|---|
| 5,793,342 | A * | 8/1998 | Rhoads | 345/76 |
| 6,724,174 | B1 * | 4/2004 | Esteves et al. | 323/224 |
| 6,750,842 | B2 * | 6/2004 | Yu | 345/102 |
| 6,936,975 | B2 * | 8/2005 | Lin et al. | 315/224 |
| 2001/0013854 | A1 * | 8/2001 | Ogoro | 345/102 |
| 2002/0118182 | A1 * | 8/2002 | Weindorf | 345/204 |
| 2004/0051691 | A1 * | 3/2004 | Hedrick | 345/102 |
| 2004/0051692 | A1 * | 3/2004 | Hirakata et al. | 345/102 |
| 2004/0155853 | A1 * | 8/2004 | Lin | 345/102 |

* cited by examiner

*Primary Examiner*—Amr A. Awad
*Assistant Examiner*—Stephen Sherman
(74) *Attorney, Agent, or Firm*—Robert A. Diehl

(57) ABSTRACT

An indicator of a brightness level for a backlight is received. The backlight has a voltage inverter. Either a continuous mode of operation for the voltage inverter or a burst mode of operation for the voltage inverter is selected based at least in part on the indicator.

23 Claims, 7 Drawing Sheets

SELECTABLE CONTINUOUS AND BURST MODE BACKLIGHT VOLTAGE INVERTER

FIELD OF THE INVENTION

The present invention relates to the field of voltage inverters. More specifically, the present invention relates to a backlight voltage inverter with selectable continuous and burst mode operation.

BACKGROUND

A voltage inverter is commonly used to power the backlight in a variety of display devices, such as a liquid crystal display (LCD). In an LCD, a backlight illuminates the back side of an array of thin-film transistors. Each of the transistors in the thin-film array acts like a tiny shutter that can open or close to pass more or less light from the backlight. Each transistor may represent one tiny dot on an LCD, and an LCD may include hundreds of thousand, or even millions, of these tiny dots. By individually controlling the amount of light passed by each transistor, an image can be displayed on an LCD.

A backlight often uses a relatively high voltage, alternating current (AC) power source. Many devices, however, primarily use comparatively low voltage, direct current (DC) power sources. For instance, a typical laptop computer may provide 3.3 volts DC to power its display. A typical backlight, such as a cold cathode florescent lamp (CCFL), may require 2000 volts root mean square (rms), which is an AC signal.

A voltage inverter is commonly used in displays because a voltage inverter can convert small DC voltage, such as a battery DC, to large AC voltage, such as 2000 volts rms. A voltage inverter, however, can consume a relatively large amount of power in many devices. High power consumption can be undesirable, especially in mobile devices like laptop computers.

BRIEF DESCRIPTION OF DRAWINGS

Examples of the present invention are illustrated in the accompanying drawings. The accompanying drawings, however, do not limit the scope of the present invention. Similar references in the drawings indicate similar elements.

DETAILED DESCRIPTION OF THE INVENTION

Figure 1:
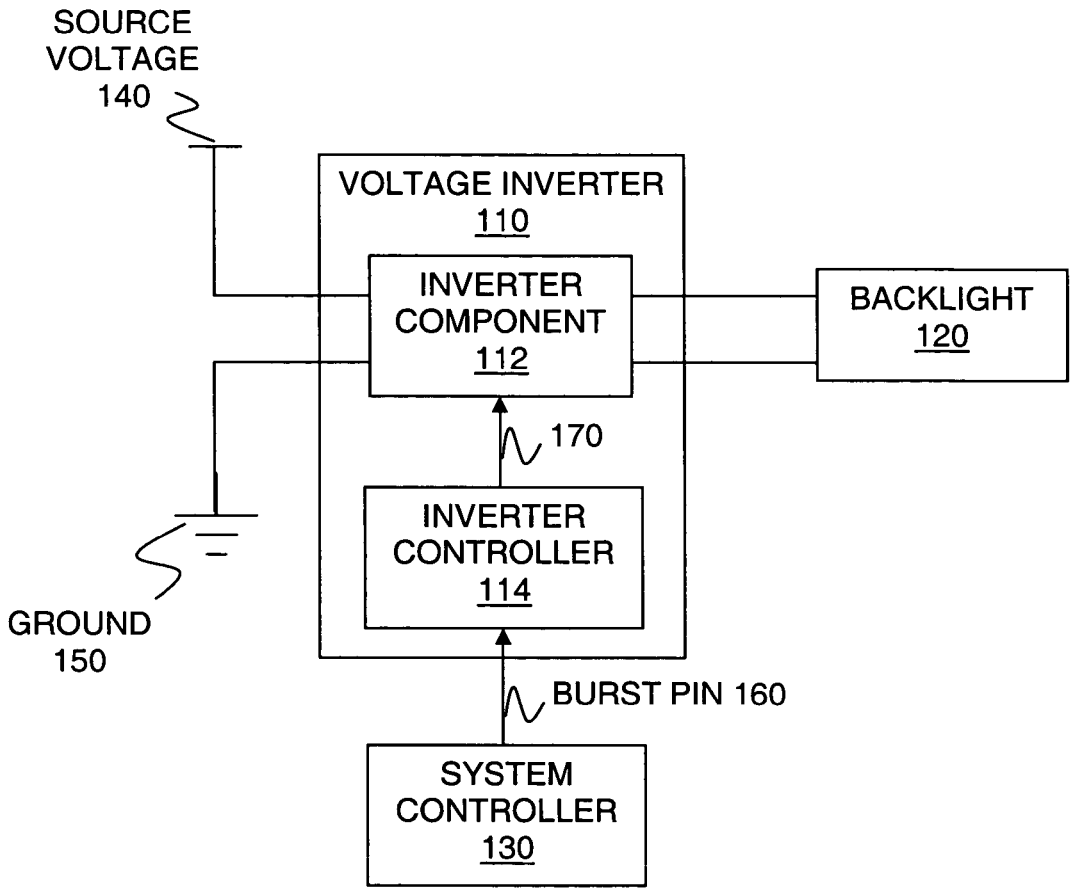
FIG. 1 illustrates one embodiment of the present invention.

In the following detailed description, numerous specific details are set forth in order to provide a thorough understanding of the present invention. However, those skilled in the art will understand that the present invention may be practiced without these specific details, that the present invention is not limited to the depicted embodiments, and that the present invention may be practiced in a variety of alternative embodiments. In other instances, well known methods, procedures, components, and circuits have not been described in detail.

Parts of the description will be presented using terminology commonly employed by those skilled in the art to convey the substance of their work to others skilled in the art. Also, parts of the description will be presented in terms of operations performed through the execution of programming instructions. As well understood by those skilled in the art, these operations often take the form of electrical, magnetic, or optical signals capable of being stored, transferred, combined, and otherwise manipulated through, for instance, electrical components.

Various operations will be described as multiple discrete steps performed in turn in a manner that is helpful for understanding the present invention. However, the order of description should not be construed as to imply that these operations are necessarily performed in the order they are presented, nor even order dependent. Lastly, repeated usage of the phrase "in one embodiment" does not necessarily refer to the same embodiment, although it may.

Embodiments of the present invention can improve the average efficiency, and reduce the average power consumption, of a backlight voltage inverter in situations where the backlight is used at a variety of power levels over time.

A voltage inverter can be operated in at least two different modes, a continuous mode and a burst mode. The two different modes exhibit different efficiency characteristics. Continuous mode tends to be more efficient when the backlight is at higher power levels and less efficient when the backlight is at lower power levels. Conversely, burst mode tends to be more efficient than continuous mode at lower power levels and less efficient at higher power levels. So, when a backlight is used at a variety of power levels over time, the power consumption of the voltage inverter can be improved by selecting the mode of operation that will be more efficient at any instant in time.

Today's backlight subsystem often uses a Cold Cathode Florescent Lamp (CCFL). CCFL's optical output is dependent on several input parameters such as input electrical driving stimulus, temperature, etc. However, there may be no way to directly determine the power level at which a backlight is operating. In other words, a backlight usually does not provide a feedback power level signal.

Embodiments of the present invention, however, take advantage of the fact that the brightness of a display is often closely related to the input driving power level of the backlight. That is, embodiments of the present invention can select a mode of operation for a backlight voltage inverter based at least in part on the brightness setting of the display.

The brightness setting of a display can be changed often and for a variety of reasons. A laptop computer presents a particularly good example of this. The brightness of a display is usually controlled by adjusting the power level of the display's backlight so that less power is consumed when the brightness of the display is lower. In which case, a user may want to reduce the display's brightness in order to reduce power consumption and extend battery life. But, the level of brightness that is necessary to see a display depends on the level of ambient light. For instance, outdoors on a bright sunny day, a user may have no choice but to set the brightness at the highest level in order to see the display. On the other hand, in a dark airplane cabin, a user may be able to set the brightness at the lowest level and still see the display clearly. In addition to user input, an operating system may automatically change the display brightness on a laptop computer. For example, the operating system may adjust the brightness based on the power source being used, the level of available battery power, the level of ambient light, etc. In each of these situations, embodiments of the present invention may improve the overall power consumption of the laptop computer by selecting the more efficient mode of operation for the backlight voltage inverter at any instant in time.

Although the present invention is primarily described below in the context of a laptop computer, embodiments of the present invention can be used in a variety of devices with displays such as video cameras, hand-held computing devices, cellular phones, computer tablets, automotive LCD displays, etc.

FIG. 1 illustrates one embodiment of a device that includes a voltage inverter 110, a backlight 120, and a system controller 130. The device provides a direct current (DC) source voltage 140 and a ground 150 to voltage inverter 110. Voltage inverter 110 converts the DC source voltage 140 to an alternating current (AC) voltage to power backlight 120.

Voltage inverter 110 includes an inverter component 112 and an inverter controller 114. Inverter controller 114 controls inverter component 112 with one or more control lines 170. Controller 114 can operate component 112 in either a continuous mode or a burst mode. The mode that is used at any instant in time can be determined by the value on burst pin 160 from system controller 130.

The value on burst pin 160 may be an indication of the brightness setting for backlight 120. System controller 130 can generate this brightness indicator in any number of ways. For instance, user input or an operating system function may adjust the display's brightness level. System controller 130 can then compare the current brightness level to a threshold brightness level. If the current brightness level is over the threshold, the brightness indicator may be set high. In which case, inverter controller may operate inverter component 112 in continuous mode because continuous mode is likely to be more efficient for high brightness. Conversely, if the current brightness level is below the threshold, the brightness indicator may be set low. In which case, the inverter controller may operate inverter component 112 in burst mode because burst mode is likely to be more efficient for low brightness.

FIG. 1 illustrates a number of implementation-specific details. Other embodiments may not include all of the illustrated elements, may include additional elements, may arrange elements in a different order, may combine one or more elements, and the like. For example, other embodiments may incorporate the functions of system controller 130 into voltage inverter 110. In which case, rather than a single burst pin 160, inverter 110 may include a register to store, or a bus to receive, a multi-bit value representing the current brightness level. Furthermore, any of a number of hardware circuits can be used to perform the various functions of the elements shown in FIG. 1. Alternately, one or more of the functions described in FIG. 1 may be performed by code executed in a processor.

Figure 2:
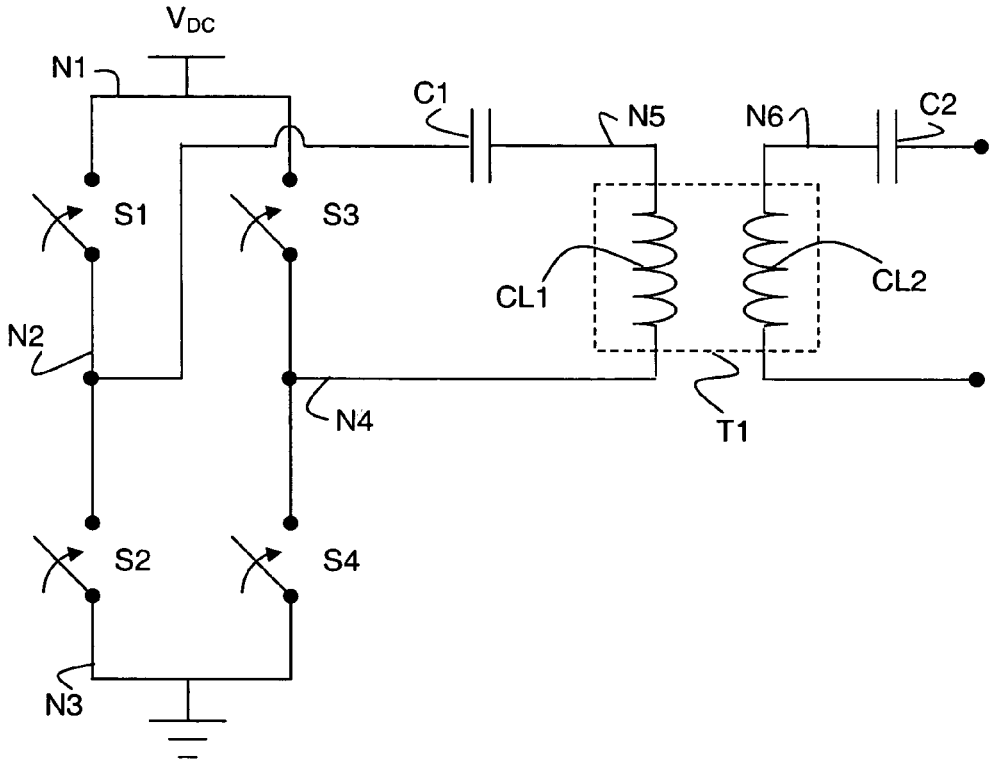
FIG. 2 illustrates one embodiment of a voltage inverter circuit.

FIG. 2 illustrates one embodiment of a circuit that can be used for inverter component 112 from FIG. 1. The illustrated embodiment includes four switches, S1, S2, S3, and S4, a transformer T1, and two capacitors, C1 and C2. S1 is coupled between nodes N1 and N2. Node N1 is coupled to the source voltage, $V_{DC}$. S2 is coupled between nodes N2 and N3. Node N3 is coupled to the system ground. S3 is coupled between nodes N1 and N4. And, S4 is coupled between nodes N3 and N4.

Capacitor C1 is coupled between nodes N2 and N5. The coil CL1 (a.k.a. primary) of transformer T1 is coupled between nodes N4 and N5. The other coil CL2 (a.k.a. secondary) of T1 is coupled between node N6 and an output terminal. Capacitor C2 is coupled between node N6 and the other output terminal. The output terminals can be coupled to two terminals of a backlight.

Figure 3:
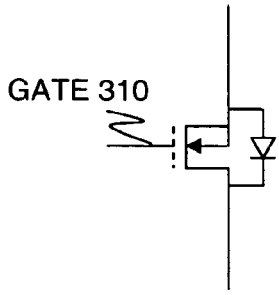
FIG. 3 illustrates one embodiment of a field effect transistor.

The switches can be opened and closed in any number of ways. For example, the switches can be coupled to the inverter controller 114 from FIG. 1 through four control lines 170. In one embodiment, the switches are field effect transistors (FETs), such as the one shown in FIG. 3. The controller can open and close a FET by applying or removing voltage from the gate input 310.

In one embodiment, in continuous mode, switches S1 and S4 are switched in phase. That is, the switches are opened and closed in unison. Switches S2 and S3 are also switched in phase, but S1 and S4 are switched 180 degrees out of phase with S2 and S3. That is, when S1 and S4 are closed, S2 and S3 are open, and when S2 and S3 are closed, S1 and S4 are open.

Figure 4:
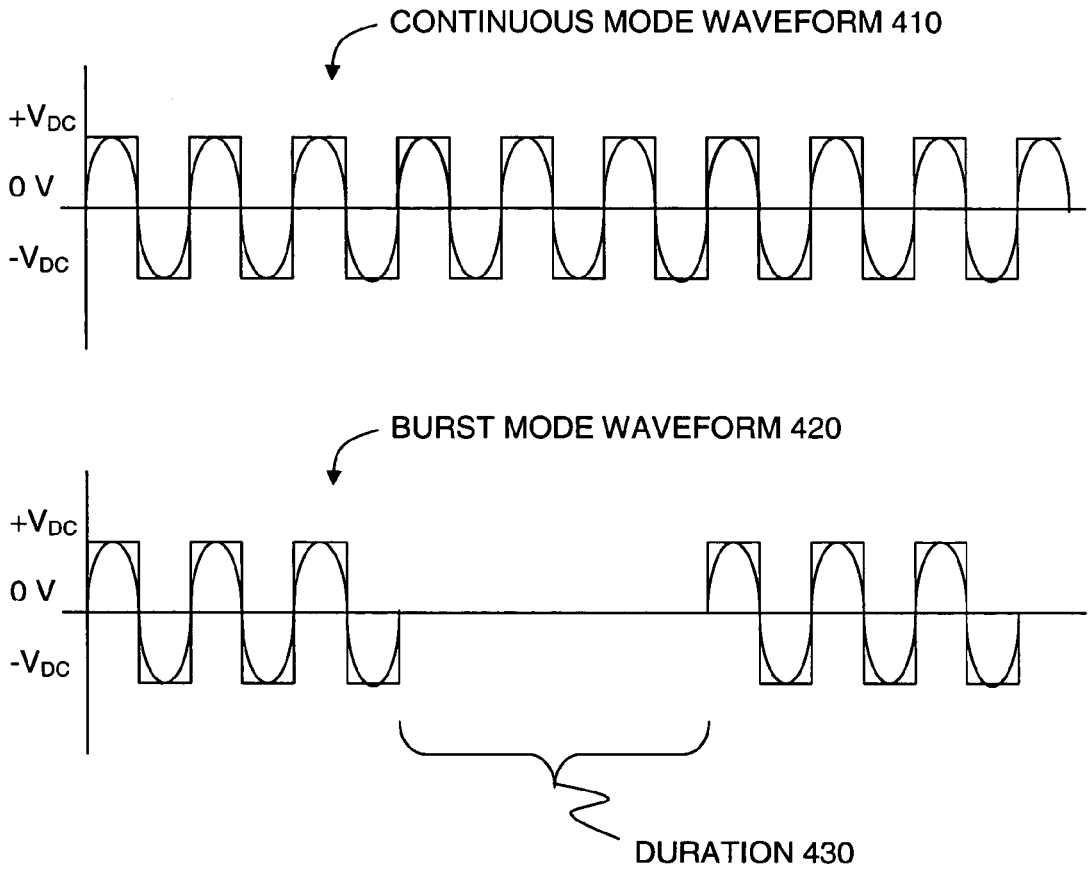
FIG. 4 illustrates embodiments of continuous mode and burst mode waveforms.

By switching back and forth between open and closed pairs of switches, the voltage across coil CL1 from node N5 to N4 is alternately pulled from the positive source voltage, $+V_{DC}$, to the negative source voltage, $-V_{DC}$. Capacitor C1 rounds off the edges of the voltage transitions to create a sinusoidal waveform. Waveform 410 in FIG. 4 illustrates the instantaneous voltage transitions and the resulting sinusoid. This is how the DC source voltage is converted to an AC signal. An appropriate switching frequency for a typical backlight may be, for instance, 60 KHz.

Transformer T1 can provide the voltage conversion. For example, if the AC voltage across CL1 is 10 volts rms and the backlight needs 2000 volts rms, the coil ratio of CL2 to CL1 would be 200 to 1.

In burst mode, the switches operate similar to that of continuous mode except there are "resting" durations 430 at certain intervals as shown in waveform 420 in FIG. 4. During a resting duration 430, all of the switches are off at the same time.

Figure 5:
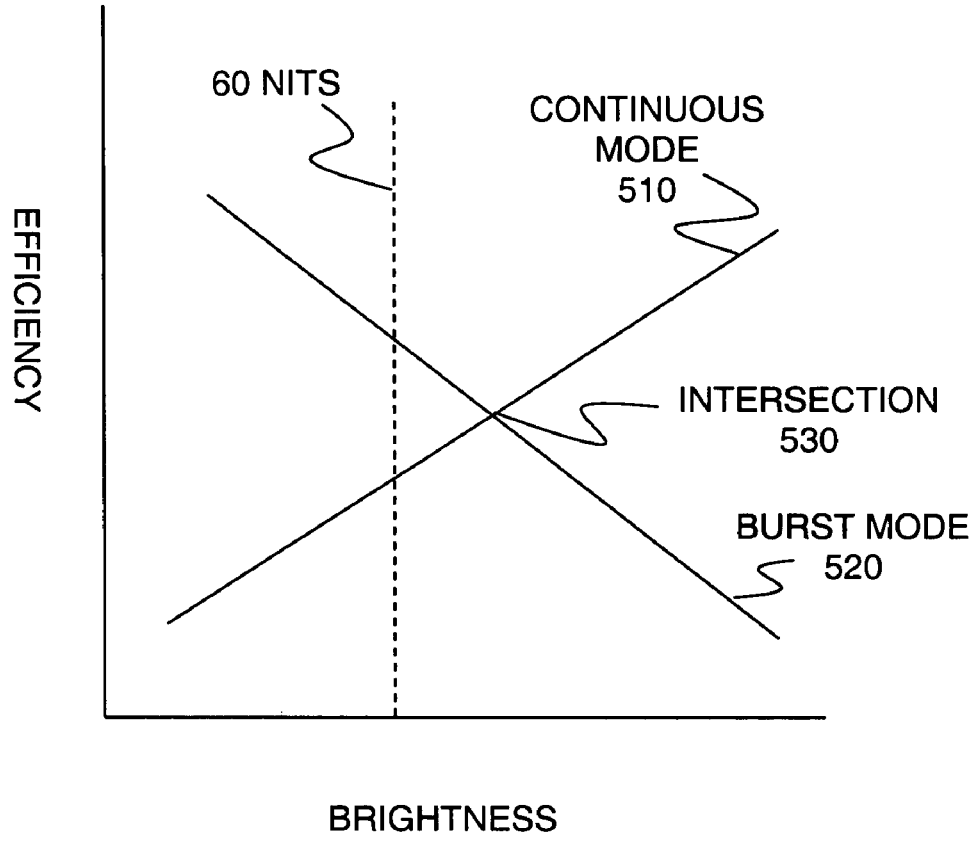
FIGS. 5-7 illustrate qualitative examples of continuous and burst mode efficiency curves for various brightness thresholds.

FIG. 5 is a qualitative illustration of efficiency verses brightness for a typical voltage inverter. The efficiency curve for continuous mode operation 510 tends to increase with increasing brightness. The efficiency curve for burst mode operation 520 tends to decrease with increasing brightness. In which case, at lower brightness levels, burst mode 520 tends to be more efficient. At higher brightness levels, continuous mode 510 tends to be more efficient.

Figure 6:
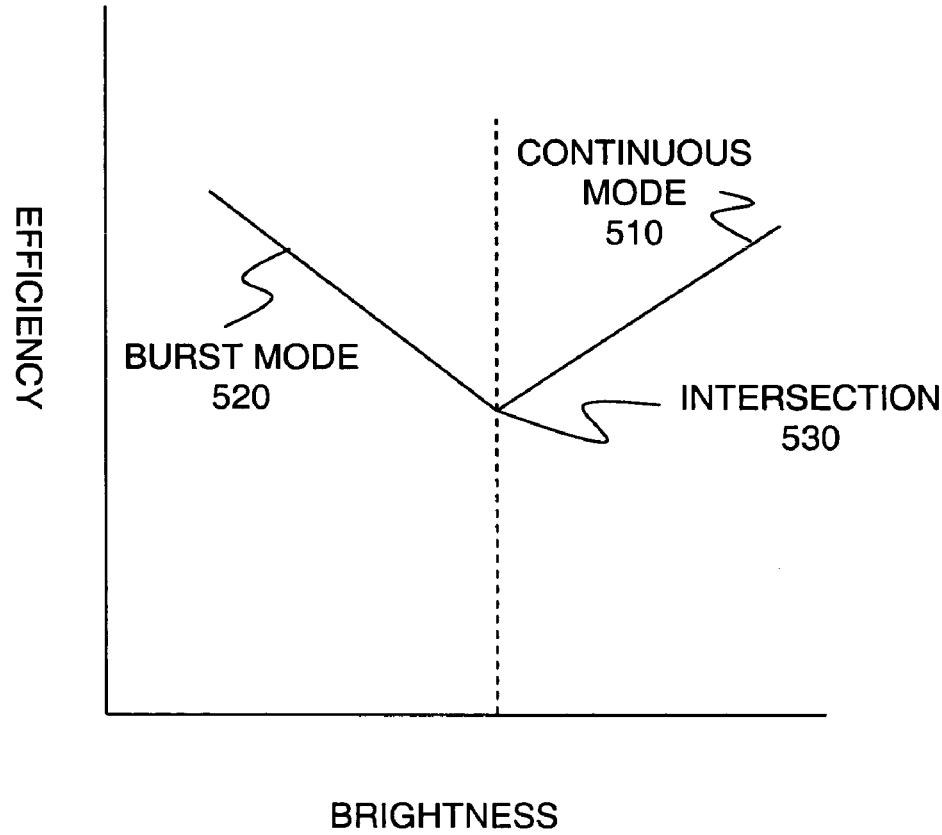

Any number of approaches can be used to select a brightness threshold for switching between the two modes. In one embodiment, the intersection 530 between the two curves can be determined or approximated experimentally by measuring the efficiency of the voltage inverter in both modes of operation over a range of brightnesses. Using the intersection 530 as the brightness threshold could provide an overall efficiency curve for the voltage inverter as qualitatively illustrated in FIG. 6.

Although this approach may provide an excellent brightness threshold, calibrating the threshold in this way can be expensive and time consuming, especially if the threshold is different for different systems, devices, inverters, controllers, etc. Another approach is simply to select a threshold that is likely to be near the transition 530 in most situations. This approach may not provide the best possible overall efficiency for all voltage inverters, but efficiency will most likely improve, and without the cost of calibration.

For example, 60 NITS (candela/meter$^2$) may be a good brightness threshold for many laptop computers. A typical display brightness may vary from around 20 NITS to around 160 NITS. 60 NITS is a common benchmark used for measuring the battery life of laptop computers. That is, a battery life number for a laptop is usually based on the assumption that the display screen is dimmed down to 60 NITS.

Figure 7:
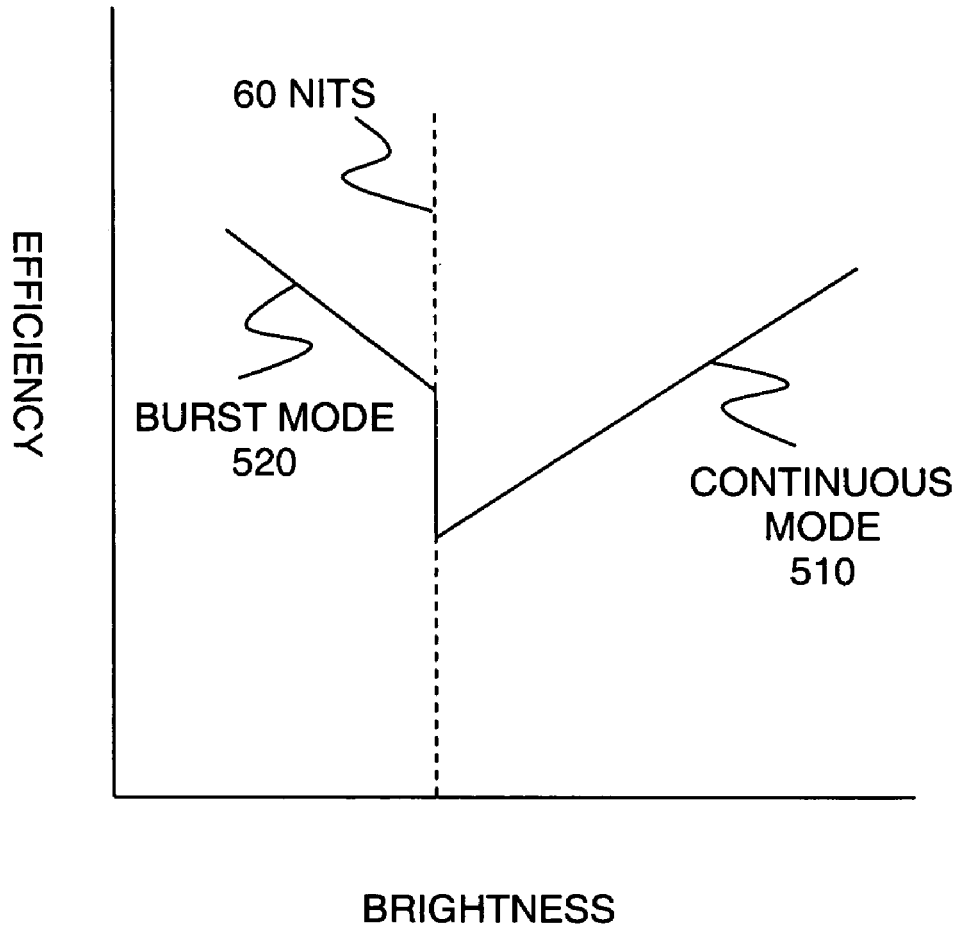

As shown in FIG. 5, the 60 NITS benchmark tends to be to the left of, and fairly near, the intersection 530 of the two efficiency curves for a typical display. FIG. 7 qualitatively illustrates what the overall efficiency curve may look like using the 60 NITS benchmark as the brightness threshold.

Figure 8:
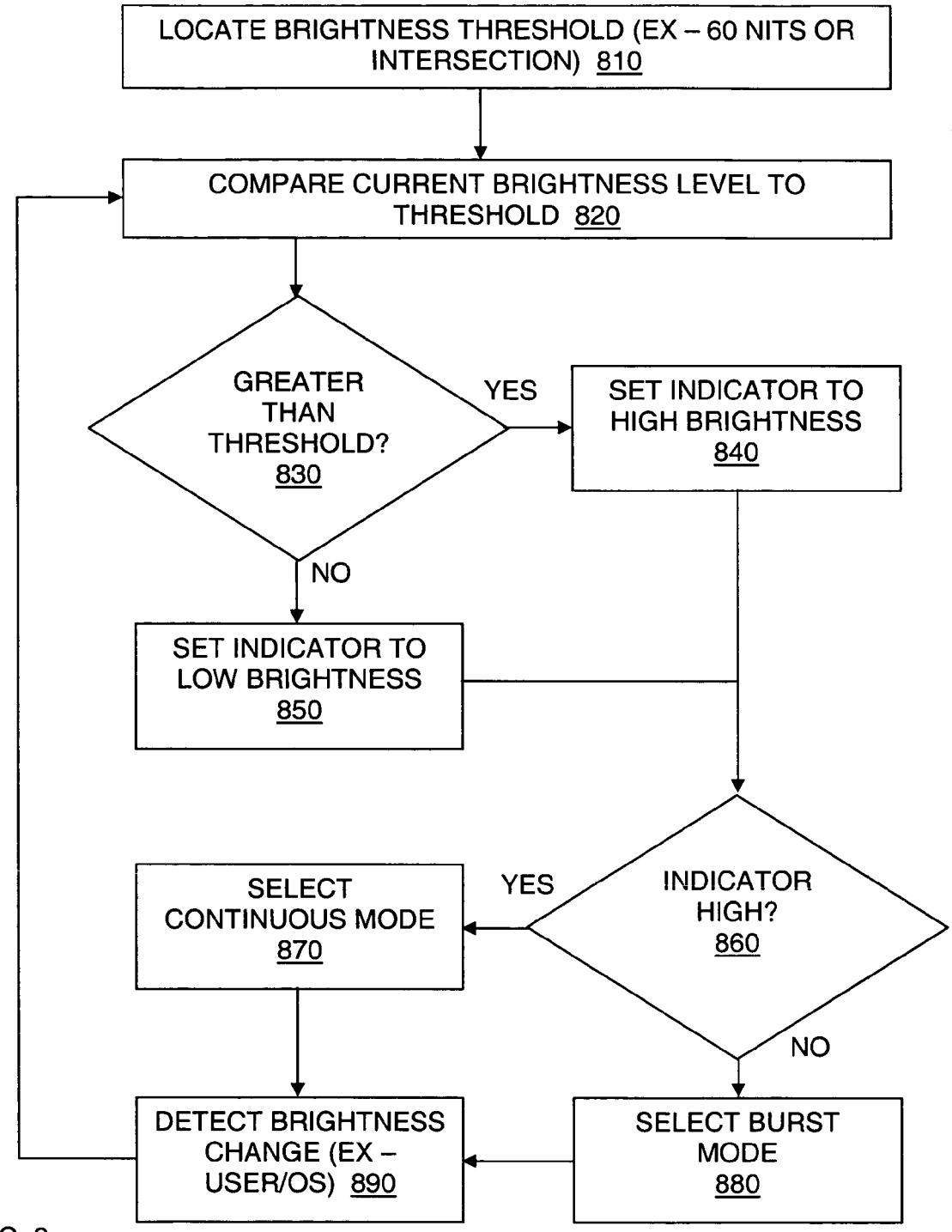
FIG. 8 demonstrates a method of one embodiment of the present invention.

In general, embodiments of the present invention switch a backlight voltage inverter between modes of operation based on a brightness level of the backlight. FIG. 8 illustrates one particular embodiment of the inventive method in more detail.

At 810, the method locates a brightness threshold for switching between the two modes of operation. As discussed above, this could be as simple as reading a user-defined threshold level from a register, such as the 60 NITS benchmark, or it could be a more complicated calibration process, such as experimentally measuring efficiency curves and determining or approximating an intersection between them.

At 820, the method compares a current brightness level of the backlight to the threshold. At 830, if the current brightness level is greater than the threshold, the method sets an indicator to a high brightness level at 840. If the current brightness level is not greater than the threshold, the method sets the indicator to a low brightness level at 850.

At 860, if the indicator indicates a high brightness, the method selects the continuous mode of operation at 870. If the indicator indicates a low brightness, the method selects the burst mode of operation at 880.

At 890, the method then waits for a change in the brightness level. For instance, a user or operating system may change the brightness level. If the brightness level changes, the method returns to 820 to repeat the process of selecting the appropriate mode of operation.

FIG. 8 illustrates a number of implementation-specific details. Other embodiments may not include all of the illustrated elements, may include additional elements, may arrange elements in a different order, may combine one or more elements, and the like.

Figure 9:
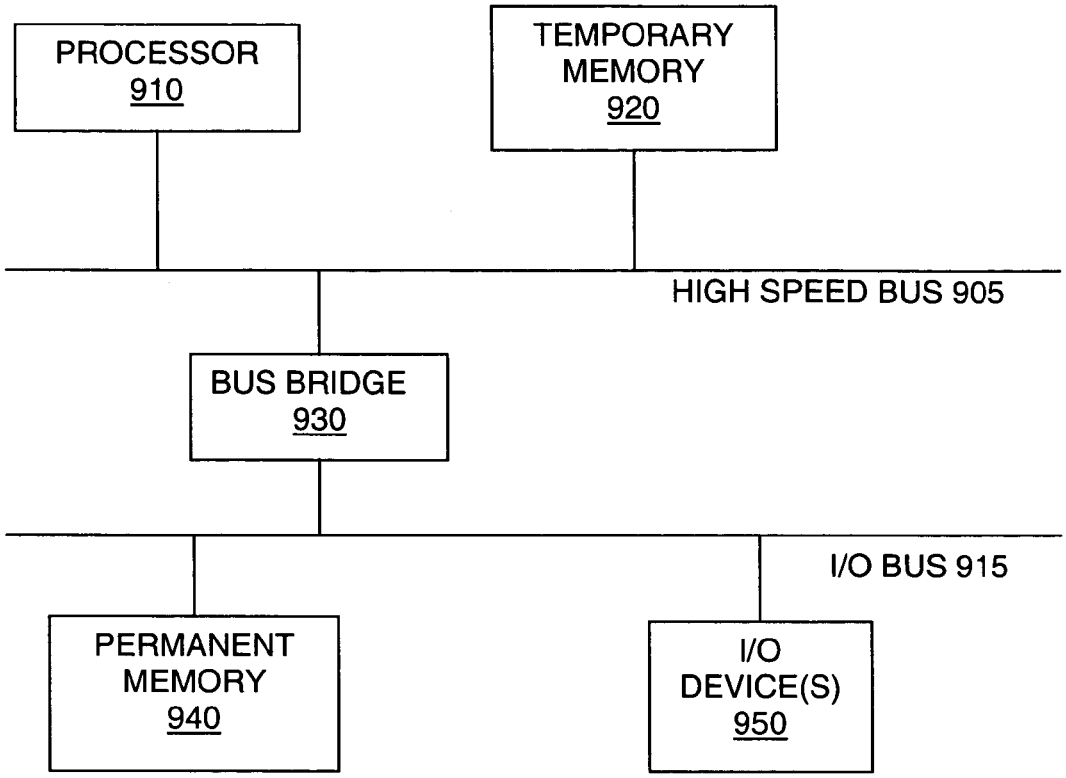
FIG. 9 illustrates one embodiment of hardware system that can perform various functions of the present invention.

FIG. 9 illustrates one embodiment of a generic hardware system intended to represent a broad category of computer systems such as personal computers, workstations, and/or embedded systems. In the illustrated embodiment, the hardware system includes processor 910 coupled to high speed bus 905, which is coupled to input/output (I/O) bus 915 through bus bridge 930. Temporary memory 920 is coupled to bus 905. Permanent memory 940 is coupled to bus 915. I/O device(s) 950 is also coupled to bus 915. I/O device(s) 950 may include a display device, a keyboard, one or more external network interfaces, etc.

Certain embodiments may include additional components, may not require all of the above components, or may combine one or more components. For instance, temporary memory 920 may be on-chip with processor 910. Alternately, permanent memory 940 may be eliminated and temporary memory 920 may be replaced with an electrically erasable programmable read only memory (EEPROM), wherein software routines are executed in place from the EEPROM. Some implementations may employ a single bus, to which all of the components are coupled, or one or more additional buses and bus bridges to which various additional components can be coupled. Similarly, a variety of alternate internal networks could be used including, for instance, an internal network based on a high speed system bus with a memory controller hub and an I/O controller hub. Additional components may include additional processors, a CD ROM drive, additional memories, and other peripheral components known in the art.

In one embodiment, various functions of the present invention, as described above, could be implemented using one or more hardware systems such as the hardware system of FIG. 9. Where more than one computer is used, the systems can be coupled to communicate over an external network, such as a local area network (LAN), an internet protocol (IP) network, etc. In one embodiment, one or more functions of the present invention as described above may be implemented as software routines executed by one or more execution units within the computer(s). For a given computer, the software routines can be stored on a storage device, such as permanent memory 940.

Figure 10:
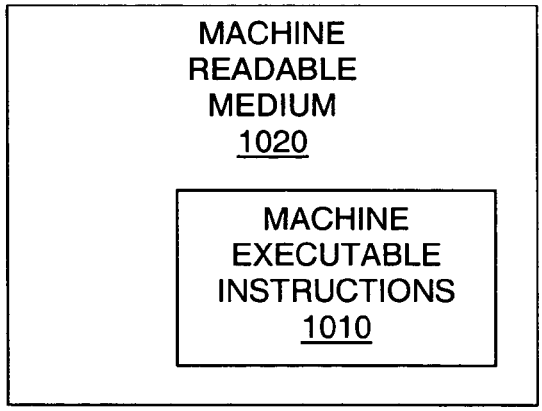
FIG. 10 illustrates one embodiment of a machine readable medium to store instructions that can implement various functions of the present invention.

Alternately, as shown in FIG. 10, the software routines can be machine executable instructions 1010 stored using any machine readable storage medium 1020, such as a hard drive, a diskette, CD-ROM, magnetic tape, digital video or versatile disk (DVD), laser disk, ROM, Flash memory, etc. The series of instructions need not be stored locally, and could be received from a remote storage device, such as a server on a network, a CD-ROM device, a floppy disk, etc., through, for instance, I/O device(s) 950 of FIG. 9.

From whatever source, the instructions may be copied from the storage device into temporary memory 920 and then accessed and executed by processor 910. In one implementation, these software routines are written in the C programming language. It is to be appreciated, however, that these routines may be implemented in any of a wide variety of programming languages.

In alternate embodiments, the embodiments of the present invention described above may be implemented in discrete hardware or firmware. For example, one or more application specific integrated circuits (ASICs) could be programmed with one or more of the above described functions. In another example, one or more functions of the present invention could be implemented in one or more ASICs on additional circuit boards and the circuit boards could be inserted into the computer(s) described above. In another example, field programmable gate arrays (FPGAs) or static programmable gate arrays (SPGA) could be used to implement one or more functions of the present invention. In yet another example, a combination of hardware and software could be used to implement one or more functions of the present invention.

Thus, a selectable continuous and burst mode backlight voltage inverter is described. Whereas many alterations and modifications of the present invention will be comprehended by a person skilled in the art after having read the foregoing description, it is to be understood that the particular embodiments shown and described by way of illustration are in no way intended to be considered limiting. Therefore, references to details of particular embodiments are not intended to limit the scope of the claims.

What is claimed is:

1. A method comprising:

comparing a brightness level for a backlight to a threshold brightness level, said backlight having a voltage inverter;

if the brightness level is above the threshold brightness level, setting an indicator to indicate a high brightness level;

if the brightness level is below the threshold brightness level, setting the indicator to indicate a low brightness level; and selecting either a continuous mode of operation for the voltage inverter or a burst mode of operation for the voltage inverter based at least in part on the indicator, wherein the threshold brightness level corresponds to an intersection of an efficiency curve of the voltage inverter in the continuous mode and an efficiency curve of the voltage inverter in the burst mode.

2. The method of claim 1 further comprising:

locating the intersection.

3. The method of claim 1 further comprising:

adjusting the brightness level based on at least one of a user input and an operating system control.

4. The method of claim 1 wherein the threshold brightness setting corresponds to 60 candela per meter squared.

5. The method of claim 1 wherein selecting either the continuous mode or the burst mode comprises:

selecting the continuous mode if the indicator indicates the high brightness level; and selecting the burst mode if the indicator indicates the low brightness level.

6. An apparatus comprising:

an inverter component for a backlight for a display;

comparison circuitry to compare a brightness level for the backlight to a threshold brightness level, set an indicator to indicate a high brightness level if the brightness level is above the threshold brightness level, and set the indicator to indicate a low brightness level if the brightness level is below the threshold brightness level; and controller circuitry to select either a continuous mode of operation for the voltage inverter or a burst mode of operation for the voltage inverter based at least in part on the indicator, wherein the threshold brightness level corresponds to an intersection of an efficiency curve of the voltage inverter in the continuous mode and an efficiency curve of the voltage inverter in the burst mode.

7. The apparatus of claim 6 wherein the inverter component comprises:

a first switch coupled between a first node and a second node, said first node to couple to a voltage source;

a second switch coupled between the second node and a third node, said third node to couple to a ground;

a third switch coupled between the first node and a fourth node;

a fourth switch coupled between the third node and the fourth node;

a first capacitive element coupled between the second node and a fifth node;

a transformer having a first coil coupled between the fourth node and the fifth node, and a second coil to couple a sixth node to a first terminal of the backlight; and a second capacitive element to couple the sixth node to a second terminal of the backlight.

8. The apparatus of claim 7 wherein the first, second, third, and fourth switches comprise field effect transistors (FETs).

9. The apparatus of claim 7 wherein the controller circuitry is to open and close the first, second, third, and fourth switches.

10. The apparatus of claim 7 wherein, in the continuous mode, the first and fourth switches are switched in phase, the second and third switches are switched in phase, and the first and fourth switches are switched 180 degrees out of phase with the second and third switches.

11. The apparatus of claim 7 wherein, in the burst mode, the first, second, third, and fourth switches are open during a resting duration.

12. The apparatus of claim 6 wherein the controller circuitry comprises:

an indicator pin to receive the indicator from the comparison circuitry.

13. A computer readable medium having stored thereon computer executable instructions that, when executed, implement a method comprising:

comparing a brightness level for a backlight to a threshold brightness level, said backlight having a voltage inverter;

if the brightness level is above the threshold brightness level, setting an indicator to indicate a high brightness level;

if the brightness level is below the threshold brightness level, setting the indicator to indicate a low brightness level; and selecting either a continuous mode of operation for the voltage inverter or a burst mode of operation for the voltage inverter based at least in part on the indicator, wherein the threshold brightness level corresponds to an intersection of an efficiency curve of the voltage inverter in the continuous mode and an efficiency curve of the voltage inverter in the burst mode.

14. The computer readable medium of claim 13 wherein the method further comprises:

locating the intersection.

15. The computer readable medium of claim 13 wherein the method further comprises:

adjusting the brightness level based on at least one of a user input and an operating system control.

16. The computer readable medium of claim 13 wherein the threshold brightness setting corresponds to 60 candela per meter squared.

17. The computer readable medium of claim 13 wherein selecting either the continuous mode or the burst mode comprises:

selecting the continuous mode if the indicator indicates the high brightness level; and selecting the burst mode if the indicator indicates the low brightness level.

18. A system comprising:

a display;

a cold cathode florescent lamp (CCFL) in the display; and a voltage inverter comprising an inverter component for the CCFL, comparison circuitry to compare a brightness level for the CCFL to a threshold brightness level, set an indicator to indicate a high brightness level if the brightness level is above the threshold brightness level, and set the indicator to indicate a low brightness level if the brightness level is below the threshold brightness level, and controller circuitry to select either a continuous mode of operation for the voltage inverter or a burst mode of operation for the voltage inverter based at least in part on the indicator, wherein the threshold brightness level corresponds to an intersection of an efficiency curve of the voltage inverter in the continuous mode and an efficiency curve of the voltage inverter in the burst mode.

19. The system of claim 18 wherein the inverter component comprises:

a first switch coupled between a first node and a second node, said first node to couple to a voltage source;

a second switch coupled between the second node and a third node, said third node to couple to a ground;

a third switch coupled between the first node and a fourth node;

a fourth switch coupled between the third node and the fourth node;

a first capacitive element coupled between the second node and a fifth node;

a transformer having a first coil coupled between the fourth node and the fifth node, and a second coil to couple a sixth node to a first terminal of the backlight; and a second capacitive element to couple the sixth node to a second terminal of the backlight.

20. The system of claim 19 wherein the controller circuitry is to open and close the first, second, third, and fourth switches.

21. The system of claim 19 wherein, in the continuous mode, the first and fourth switches are switched in phase, the second and third switches are switched in phase, and the first and fourth switches are switched 180 degrees out of phase with the second and third switches.

22. The system of claim 19 wherein, in the burst mode, the first, second, third, and fourth switches are open during a resting duration.

23. The system of claim 18 wherein the controller circuitry comprises:

an indicator pin to receive the indicator.

* * * * *